US011690397B2

(12) United States Patent
Sirani Fornasini

(10) Patent No.: US 11,690,397 B2
(45) Date of Patent: Jul. 4, 2023

(54) RECONFIGURABLE WRAPPING MECHANISM

(71) Applicant: PHILIP MORRIS PRODUCTS S.A., Neuchatel (CH)

(72) Inventor: Mauro Sirani Fornasini, Bolognese (IT)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 17/263,716

(22) PCT Filed: Jul. 31, 2019

(86) PCT No.: PCT/EP2019/070626
§ 371 (c)(1),
(2) Date: Jan. 27, 2021

(87) PCT Pub. No.: WO2020/025671
PCT Pub. Date: Feb. 6, 2020

(65) Prior Publication Data

US 2021/0368857 A1 Dec. 2, 2021

(30) Foreign Application Priority Data

Aug. 3, 2018 (EP) ..... 18187372

(51) Int. Cl.
*A24C 5/18* (2006.01)
*A24C 5/00* (2020.01)

(52) U.S. Cl.
CPC ..... *A24C 5/1807* (2013.01); *A24C 5/002* (2013.01); *A24C 5/1835* (2013.01)

(58) Field of Classification Search
CPC ..... A24C 5/002; A24C 5/18; A24C 5/1807; A24C 5/1835
See application file for complete search history.

(56) References Cited

U.S. PATENT DOCUMENTS

2017/0013872 A1 1/2017 Williams

FOREIGN PATENT DOCUMENTS

| | | |
|---|---|---|
| DE | 2836030 | 3/1979 |
| DE | 102010051894 | 5/2012 |
| DE | 102012208450 | 11/2013 |
| EP | 2 641 483 | 9/2013 |

(Continued)

OTHER PUBLICATIONS

Search Report and Written Opinion for PCT/EP2019/070626 dated Oct. 22, 2019 (11 pages).

(Continued)

*Primary Examiner* — Eric Yaary
(74) *Attorney, Agent, or Firm* — Mueting Raasch Group

(57) ABSTRACT

A reconfigurable wrapping mechanism (100, 200, 300, 400, 500, 600) for forming a substantially cylindrical wrapped element by wrapping a core (160, 560) within a web material, comprising: a reconfigurable garniture bed (110, 210, 310, 410) having an elongate formation channel (212) that has an elongate open side; a conveying belt (120, 220, 320, 420, 520) extending along the length of the elongate formation channel (212) for entraining the web material; a drive mechanism for driving the conveying belt (120, 220, 320, 420, 520) along the length of the elongate formation channel (212).

14 Claims, 7 Drawing Sheets

(56) References Cited

FOREIGN PATENT DOCUMENTS

| | | | | |
|---|---|---|---|---|
| EP | 3 320 788 | | 5/2018 | |
| GB | 574861 | | 1/1946 | |
| GB | 2189128 A | * | 10/1987 | ..... A24C 5/44 |

OTHER PUBLICATIONS

Extended European Search Report for Application No. 18187372.0 dated Feb. 21, 2019 (8 pages).
Third Party Observations issued for European Patent No. 19745160.2 dated Jul. 29, 2021 (15 pages).
Office Action issued in Europe for Application No. 19745160.2 dated Jun. 8, 2022 (7 pages).
Office Action issued in China for Application No. 201980046606.X dated Aug. 30, 2022 (9 pages).
Anonymous: Segmentiertes Format, Prior Art Journal, vol. 5, Mar. 8, 2018 (4 pages).

* cited by examiner

RECONFIGURABLE WRAPPING MECHANISM

This application is a U.S. National Stage Application of International Application No. PCT/EP2019/070626 filed Jul. 31, 2019, which was published in English on Feb. 6, 2020 as International Publication No. WO 2020/025671 A1. International Application No. PCT/EP2019/070626 claims priority to European Application No. 18187372.0 filed Aug. 3, 2018.

The present invention relates to a reconfigurable wrapping mechanism, a method of reconfiguration of a wrapping mechanism and a method of use of a reconfigurable wrapping mechanism, and more particularly to manufacturing rods for aerosol-generating articles.

The present specification relates to equipment for the manufacture of an aerosol-generating article, which may comprise an aerosol-forming substrate for generating an inhalable aerosol when heated by a heating element of an aerosol-generating device. The specification also relates to methods of using and reconfiguring equipment for the manufacture of an aerosol-generating article.

Wrapped rods are formed in the manufacture of aerosol-generating articles, for example being any of an aerosol-forming substrate, a support element, an aerosol-cooling element, and a mouthpiece.

A wrapped rod may be formed by passing a web of wrapping material and a core through an assembly known as a 'garniture', in which the web is wrapped and sealed around the core. The garniture assembly has an elongate formation channel with an open side extending along its length, and a shoe positioned close to at least part of the open side, and a belt that is driven through the formation channel, along the concave surface of the formation channel. The web is entrained onto the belt and drawn through the formation channel, with the core positioned onto the belt. The formation channel and shoe cooperate to wrap the web around the core, with at least part of the garniture forming a generally cylindrical channel between the shoe, belt and formation channel. A heating element may be provided in part of the shoe to thermoset an adhesive between overlapping portions of the wrapped web.

In use, the belt and the formation channel each become worn, which undesirably increases the size of the manufactured wrapped rods. To maintain manufacturing quality, it is necessary to replace the worn belts and worn formation channel assemblies, introducing additional costs into the manufacturing process and reducing manufacturing efficiency.

According to a first aspect, there is provided a reconfigurable wrapping mechanism for forming a substantially cylindrical wrapped element by wrapping a core within a web material, comprising a reconfigurable garniture bed having an elongate formation channel for supporting a conveying belt extending along the length of the elongate formation channel for entraining the web material, and wherein the elongate formation channel has an elongate open side.

According to a second aspect, there is provided a method of reconfiguring a garniture bed in a wrapping mechanism for forming a substantially cylindrical wrapped element by wrapping a core within a web material, the wrapping mechanism comprising a reconfigurable garniture bed having an elongate formation channel for supporting a conveying belt extending along the length of the elongate formation channel for entraining the web material, and wherein the elongate formation channel has an elongate open side, wherein the garniture bed comprises a plurality of garniture bed sub-members, wherein, in a direction extending around the surface of the elongate formation channel perpendicular to the length of elongate formation channel, each garniture bed sub-member provides a portion of the surface of the elongate formation channel, and wherein at least one of the garniture bed sub-members is configured for movement transverse to the length of the elongate formation channel, and the method comprises relative movement of the garniture bed sub-members transversely to the length of the elongate formation channel to adjust the size of the elongate formation channel.

According to a third aspect, there is provided a method of manufacturing a substantially cylindrical wrapped element with a wrapping mechanism comprising:

- a reconfigurable garniture bed having an elongate formation channel for supporting a conveying belt extending along the length of the elongate formation channel for entraining the web material, and wherein the elongate formation channel has an elongate open side;
- a conveying belt extending along the length of the elongate formation channel; and
- a drive mechanism for driving the conveying belt along the length of the elongate formation channel, the method comprising:

- driving the conveying belt and an entrained web material along the elongate formation channel with the drive mechanism;
- receiving a core onto the entrained web material; and
- wrapping the core within a web material.

The garniture bed may comprise a plurality of garniture bed sub-members, wherein, in a direction extending around the surface of the elongate formation channel perpendicular to the length of elongate formation channel, each garniture bed sub-member provides a portion of the surface of the elongate formation channel, and wherein at least one of the garniture bed sub-members is configured for movement transverse to the length of the elongate formation channel.

Each garniture bed sub-member may comprise:

- a base sub-member; and
- a replaceable formation channel liner sub-member detachably connected to a respective base sub-member.

Adjacent edges of the or a plurality of the garniture bed sub-members may be interdigitated. The or a plurality of the garniture bed sub-members may be configured for substantially symmetrical movements.

The elongate formation channel may have a central axis extending along its length and the garniture bed sub-members may be configured for substantially radial movement relative to the central axis.

The wrapping mechanism may comprise an elongate shoe provided adjacent and extending along the elongate open side of the elongate formation channel for slideably contacting at least one of the wrapped core, core and web material.

The wrapping mechanism may comprise one or both:

- the elongate shoe is configured for movement towards the garniture bed transverse to the length of elongate formation channel; and
- the garniture bed is configured for movement towards the elongate shoe transverse to the length of elongate formation channel.

The wrapping mechanism may comprise a conveying belt extending along the length of the elongate formation channel for entraining the web material.

The wrapping mechanism may comprise a drive mechanism for driving a conveying belt along the length of the elongate formation channel.

Each garniture bed sub-member may comprise:

a base sub-member; and a replaceable formation channel liner sub-member detachably connected to a respective base sub-member, and the method comprises detaching and replacing a formation channel liner sub-member.

Adjacent edges of the or a plurality of the garniture bed sub-members may be interdigitated, and the method may comprise relative movement of the garniture bed sub-members to increase or decrease the level of interdigitation.

The or a plurality of the garniture bed sub-members may be configured for substantially symmetrical movements.

The elongate formation channel may have a central axis extending along its length and the garniture bed sub-members and the method may comprise moving the garniture bed sub-members substantially radially relative to the central axis.

The wrapping mechanism may comprise:

an elongate shoe provided adjacent and extending along the elongate open side of the elongate formation channel for slideably contacting at least one of the wrapped core, core and web material, the method comprising one or both:

the elongate shoe is configured for movement towards the garniture bed transverse to the length of elongate formation channel; and the garniture bed is configured for movement towards the elongate shoe transverse to the length of elongate formation channel.

The method may comprise reconfiguration of garniture bed to provide a narrower formation channel.

The wrapping mechanism may comprise a conveying belt extending along the length of the elongate formation channel for entraining the web material, and the method may comprise reconfiguration of garniture bed to provide a wider formation channel, and the method may further comprise replacement of the conveying belt.

As used herein, the term 'aerosol-generating device' is used to describe a device that interacts with an aerosol-forming substrate of an aerosol-generating article to generate an aerosol. Preferably, the aerosol-generating device is a smoking device that interacts with an aerosol-forming substrate of an aerosol-generating article to generate an aerosol that is directly inhalable into a user's lungs thorough the user's mouth. The aerosol-generating device may be a holder for a smoking article.

Preferably, the aerosol-generating article is a smoking article that generates an aerosol that is directly inhalable into a user's lungs through the user's mouth. More, preferably, the aerosol-generating article is a smoking article that generates a nicotine-containing aerosol that is directly inhalable into a user's lungs through the user's mouth.

As used herein, the term 'aerosol-forming substrate' is used to describe a substrate capable of releasing upon heating volatile compounds, which can form an aerosol. The aerosol generated from aerosol-forming substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

The aerosol-forming substrate may be formed as a folded web (also referred to as a pleated web). The folded web may be, but is not limited to a homogenized tobacco material, for example TCL (tobacco cast leaf), and is wrapped within a wrapping paper.

As used herein, the term 'aerosol-cooling element' is used to describe an element having a large surface area and a low resistance to draw. In use, an aerosol formed by volatile compounds released from the aerosol-forming substrate passes over and is cooled by the aerosol-cooling element before being inhaled by a user. In contrast to high resistance to draw filters and other mouthpieces, aerosol-cooling elements have a low resistance to draw. Chambers and cavities within an aerosol-generating article are also not considered to be aerosol cooling elements.

As used herein, the term 'aerosol-generating device' is used to describe a device that interacts with an aerosol-forming substrate of an aerosol-generating article to generate an aerosol. Preferably, the aerosol-generating device is a smoking device that interacts with an aerosol-forming substrate of an aerosol-generating article to generate an aerosol that is directly inhalable into a user's lungs thorough the user's mouth. The aerosol-generating device may be a holder for a smoking article.

The wrapper may be a wrapper of filter paper. Preferably, the outer wrapper is a cigarette paper. However, this is not essential, and elements of aerosol-generating articles may be circumscribed by other outer wrappers.

As used herein, the term 'formation channel' is used to describe a channel for wrapping a web material around a core as the web material and core pass along the channel. At least an inlet portion of the formation channel, in which the web material is progressively wrapped around the core, in use, has a radius of curvature that decreases towards the downstream end. At the upstream end, in use, the channel may be substantially flat or have a large radius of curvature, where unwrapped materials are introduced into the formation channel. At least an outlet portion of the formation channel opens-out towards the downstream end, for example, having a radius of curvature that increases towards the downstream end, and may become flat at the downstream end.

As used herein, the term 'reconfigurable garniture bed' is used to describe a composite structure providing the formation channel or a portion of the length of the formation channel, which may be modified to compensate for wear, replacement of other parts, or both. One of the parts of the composite structure may provide the full surface of the formation channel, perpendicular to the length of the formation channel. Alternatively, a plurality of parts may each provide part of the full surface of the formation channel, perpendicular to the length of the formation channel.

As used herein, 'reconfiguration' is used to describe a modification that may be performed rapidly.

Reconfiguration of the garniture bed may include changing the size of the formation channel, for example, changing the garniture bed to provide a formation channel that is narrower or wider.

Removal of the plurality of replaceable formation channel liner sub-members, or each replaceable formation channel liner sub-member, for reconfiguration of the garniture bed may require the release of no more than two securing screws or securing bolts.

The plurality of replaceable formation channel liner sub-members is substantially smaller than the complete garniture bed. Perpendicular to the length of the formation channel, and at the location along the length of the formation channel at which the cross-sectional area of the formation channel is smallest (or at which the radius of curvature of the formation channel is smallest), the cross-sectional area of the plurality of replaceable formation channel liner sub-members may by less than the cross-sectional area of the garniture bed by a ratio of at least 10:1, at least 5:1, or at least 2:1.

As used herein, the term 'garniture bed sub-member' is used to describe an element that provides part of the full surface of the formation channel or a part of a portion of the length of the formation channel, perpendicular to the length of the formation channel. Each of the garniture bed sub-members may contact the conveying belt, in use (for example, the conveying belt may slide across each of the garniture bed-sub-members, in use). The garniture bed sub-members may be closely spaced, in use (for example, may be spaced apart by less than 20% of the narrowest width of the formation channel, spaced apart by less than 10% of the narrowest width of the formation channel, or spaced apart by less than 5% of the narrowest width of the formation channel. Being closely spaced facilitates a smooth flow of the driven conveying belt along the formation channel, and across the garniture bed sub-members and any intervening gaps between adjacent garniture bed sub-members. The garniture bed sub-members may be mechanically interconnected with a mechanism for providing relative movement (for example, lateral garniture bed sub-members may be directly connected to a central garniture bed sub-member).

As used herein, the term 'formation channel liner sub-member' is used to describe a replaceable element that provides part of the full surface of the formation channel or a part of a portion of the length of the formation channel, perpendicular to the length of the formation channel, and is detachably connected to a base sub-member that is retained when the formation channel liner sub-member is replaced.

As used herein, the term 'conveying belt' is a strip of material that is laid along the length of the formation channel, and is driven along the formation channel in use, to entrain the web of wrapping material and the core. The conveying belt is also known as a garniture belt or a garniture. As used herein, the term 'drive mechanism' is a motorised mechanism for driving the conveying belt along the formation channel. The conveying belt may be an endless loop.

As used herein, the term 'shoe' has been used to describe a member that provides a surface that is complementary to the formation channel of the garniture bed, for cooperating with the formation channel to wrap the wrapping material around the core material, in use.

In cross-section, perpendicular to the length of the formation channel, the plurality of replaceable formation channel liner sub-members is smaller than the plurality of base sub-members, which may enable the plurality of replaceable formation channel liner sub-members to be replaced without detaching the conveying belt from the remainder of the garniture bed (which comprises at least the plurality of base sub-members).

In use, the conveying belt may be held under tension by a belt tensioning mechanism, for example, a tensioning pulley, which may be a pulley rotatably mounted on a biased arm. To replace the garniture bed the tensioning mechanism may be released, to relax the conveying belt, enabling the conveying belt to be lifted from the formation channel, whilst the garniture bed is reconfigured, after which the conveying belt is replaced into the formation channel and re-tensioned by re-engaging the belt tensioning mechanism.

Advantageously, the garniture bed may be reconfigured without requiring complete removal of one or more of the garniture bed, the conveying belt, and the shoe (where present). Reconfiguration of the garniture bed without complete removal of one or more of the garniture bed, the conveying belt, and the shoe, may enable periodic servicing of the wrapping mechanism to be undertaken much more rapidly than would otherwise be the case, reducing downtime of the wrapping mechanism, and increasing manufacturing efficiency. Advantageously, reconfiguration of the wrapping mechanism without complete removal of the garniture bed or shoe, may avoid or reduce the requirement for skilled reassembly and re-alignment.

Commonly, the conveying belt is replaced more frequently than the known garniture bed. To reduce wear of the known formation channel, it is known to form garniture beds from wear resistant material, for example, stainless steel, which may additionally be provided with a hardened coating, for example, a diamond-like carbon coating. Enabling convenient reconfiguration of the garniture bed by replacement of the replaceable formation channel liner sub-members may enable the formation channel to be provided in a less wear-resistant material (for example, a plastics material), with increased wear to the garniture bed being compensated for by reconfiguration of the garniture bed. Advantageously, provision of the formation channel in a less wear-resistant material may reduce wear of the conveying belt, enabling a reduction of the frequency of periodic servicing, and reducing overall downtime of the wrapping mechanism.

Advantageously, reconfiguration of the garniture bed may enable continued use of one or both of a conveying belt and a garniture bed even when one or both have become worn, which may increase the time for which the wrapping mechanism may be run before it becomes necessary to replace the conveying belt. Prolonging the running time of parts may increase operational efficiency and reduce operational costs.

Advantageously, by reconfiguration of the garniture bed, both the substantially cylindrical shape and the cross-sectional area of the wrapped core may be maintained within narrower tolerances.

Examples are further described hereinafter with reference to the accompanying drawings, in which.

Figure 1A:
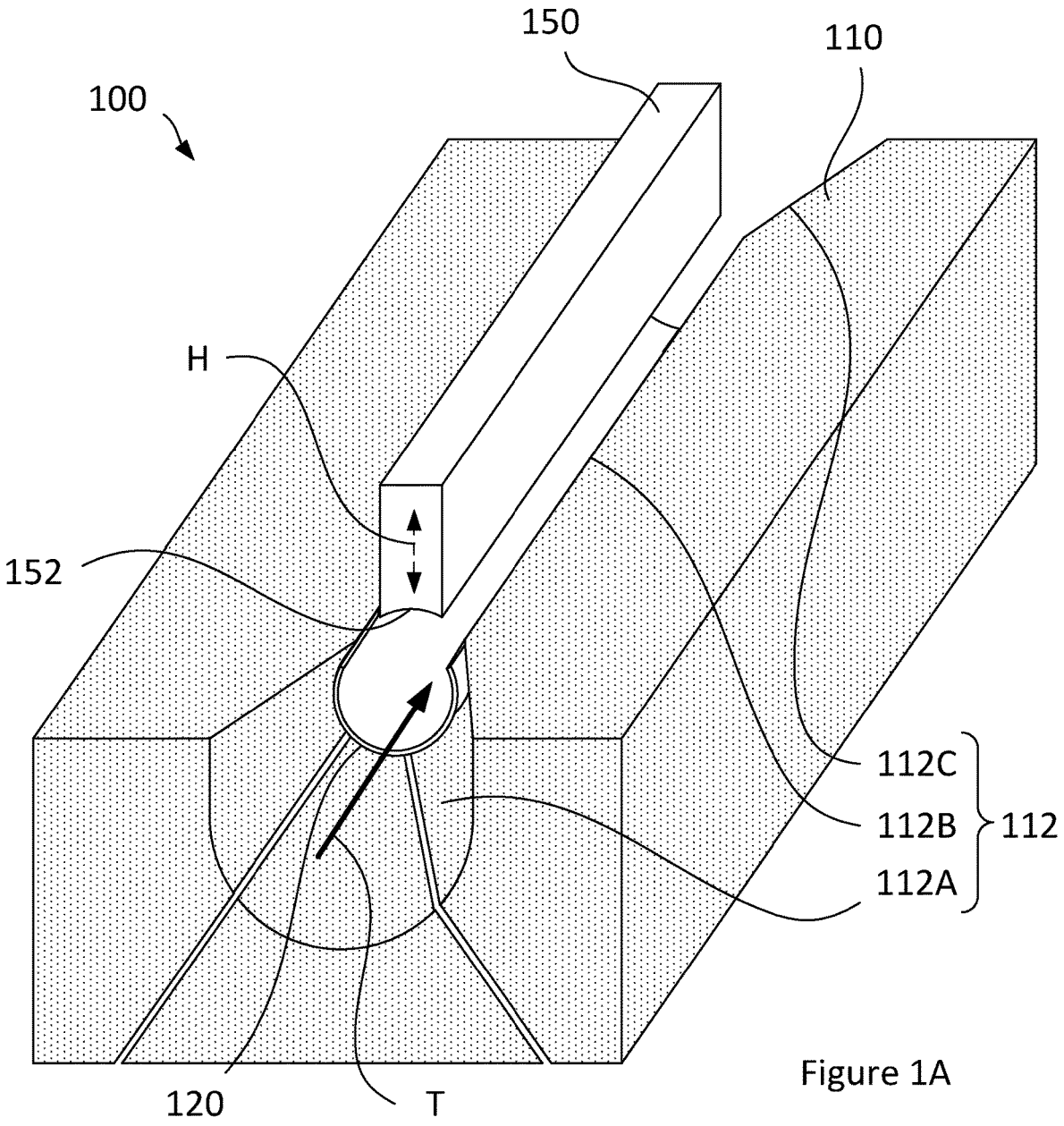
FIG. 1A shows a perspective view of a first reconfigurable wrapping mechanism.

Like reference numerals refer to like elements throughout. In the described examples, like features have been identified with like numerals, albeit in some cases having one or more of increments of integer multiples of 100. For example, in different figures, 100, 200, 300 and 500 have been used to indicate a reconfigurable wrapping mechanism.

Figure 1B:
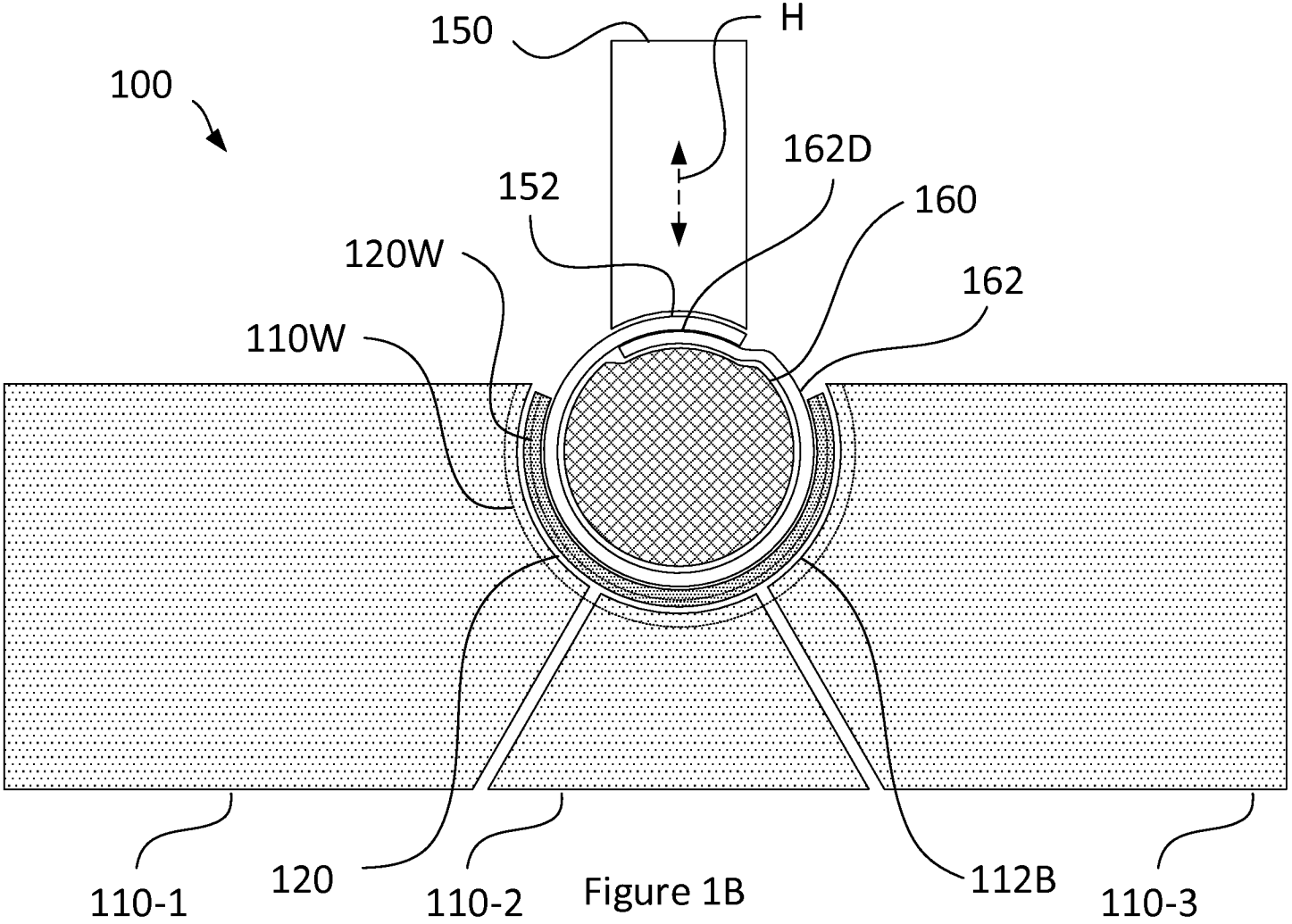
FIG. 1B shows a cross-sectional view through the first reconfigurable wrapping mechanism in an unworn condition.
Figure 1C:
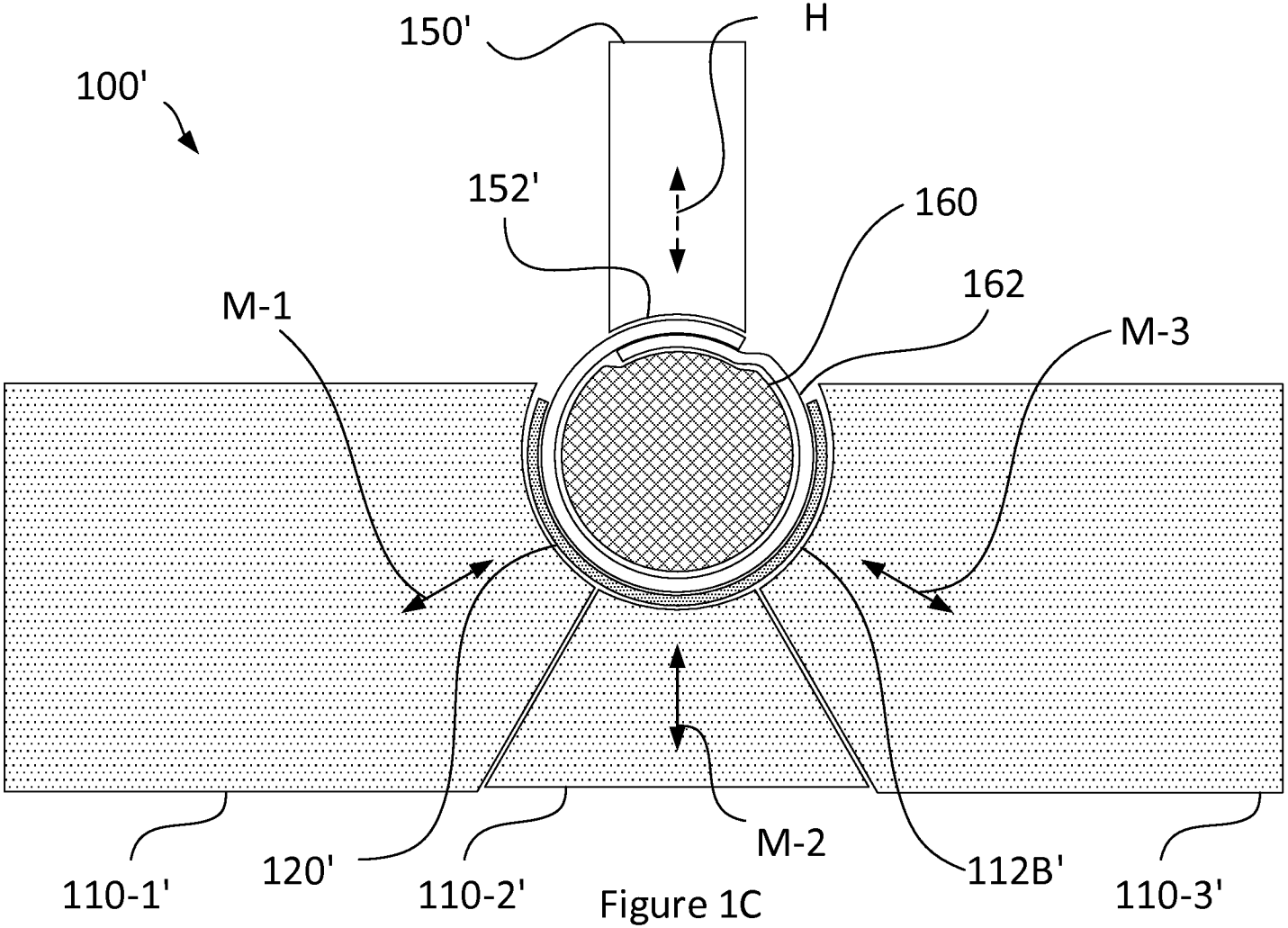
FIG. 1C shows a cross-sectional view through the first reconfigurable wrapping mechanism after reconfiguration to compensate for wear.

FIG. 1A shows a perspective view of a first reconfigurable wrapping mechanism 100. FIG. 1B shows a cross-sectional view through the first reconfigurable wrapping mechanism 100 with a conveying belt 120 and the garniture bed 110 in an unworn condition. FIG. 1C shows the first reconfigurable wrapping mechanism 100' after reconfiguration to compensate for wear of the conveying belt 120' and the garniture bed 110'.

The reconfigurable wrapping mechanism 100 has a garniture bed 110 with a formation channel 112 extending along its length. A conveying belt 120 extends along the surface of the formation channel 112, and both are open along the length of the formation channel, with the open side facing towards an elongate shoe 150.

In the illustrated garniture bed 110, the formation channel 112 has an inlet section 112A, a middle section 112B, and an outlet section 112C. The middle section 112B has a constant radius of curvature along its length. The inlet section 112A narrows-down, away from the inlet of the formation channel 112, and towards the middle section 112B. The outlet section 112C broadens-out, towards the outlet, and away from the middle section 112C.

Figure 5:
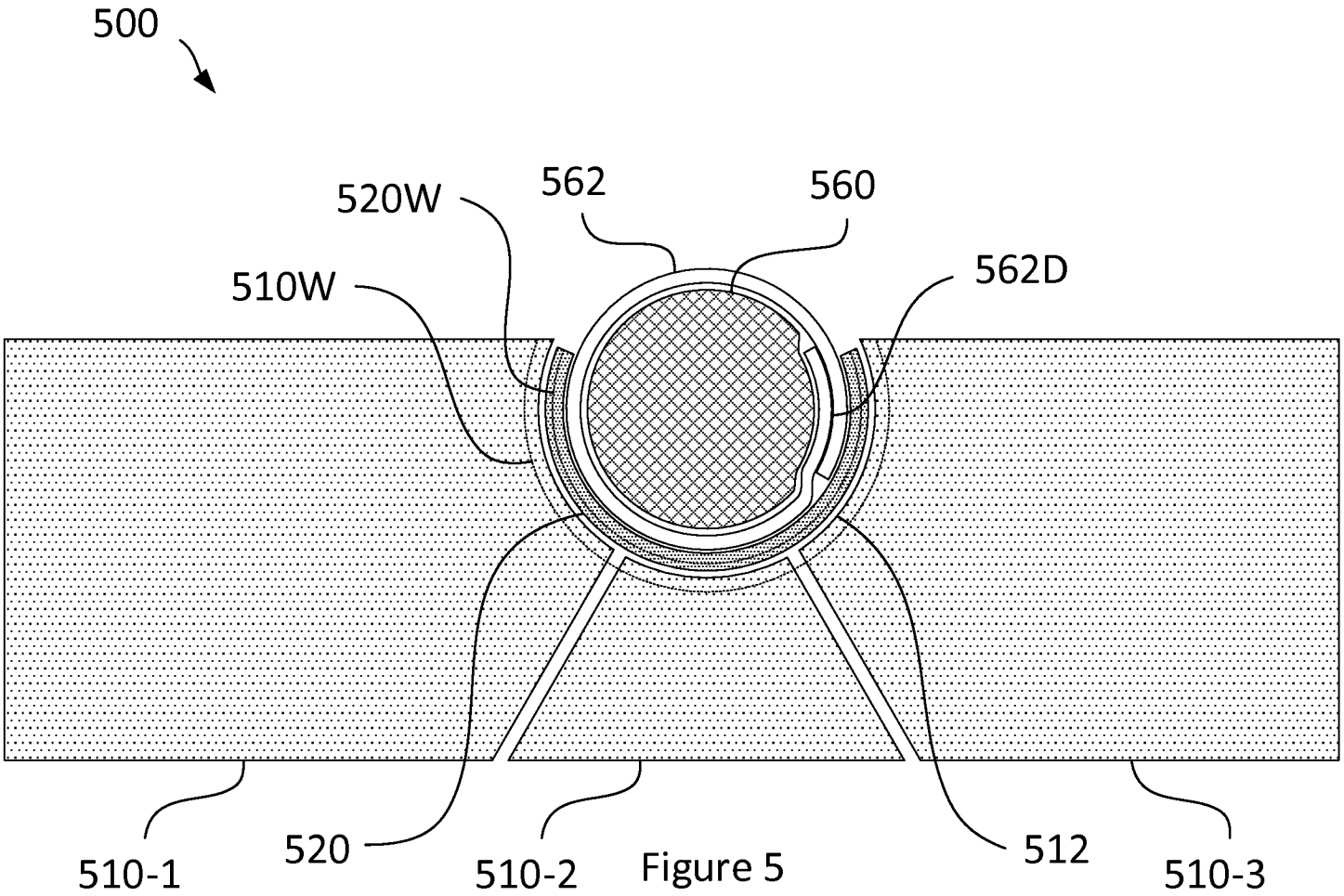
FIG. 5 shows a cross-sectional view through a fifth reconfigurable wrapping mechanism in an unworn condition.

The conveying belt 120 may be an endless belt, and only part of the conveying belt is illustrated in FIG. 1A, being the portion within the middle section 112B of the formation channel 112. A belt drive mechanism (not shown) is provided to drive the conveying belt 120 along the formation channel 112, in the transport direction T. The shoe 150 has a concave face 152, in cross-section perpendicular to the length of the formation channel 112, which faces towards the open side of the formation channel 112. The formation channel 112, conveying belt 120 and the concave face 152 of the shoe 150 are arranged and complementarily shaped for receiving a substantially cylindrical member, for example, a generally cylindrical core 160 wrapped within a wrapping paper 162. Although present in the wrapping mechanism 100 of FIG. 1A, the elongate shoe 150 is optional, and may be omitted (for example, as shown in FIG. 5).

The garniture bed 110 is reconfigurable by re-sizing the formation channel 112.

The garniture bed 110 is of a composite construction, having moveable garniture bed sub-members 110-1, 110-2 and 110-3, each providing part of the formation channel 212. The garniture bed sub-members 110-1, 110-2 and 110-3 may connect to a common support (not shown). The conveying belt 120 is in contact with the garniture bed sub-members 110-1, 110-2 and 110-3, and slides along them, in use.

Figure 2:
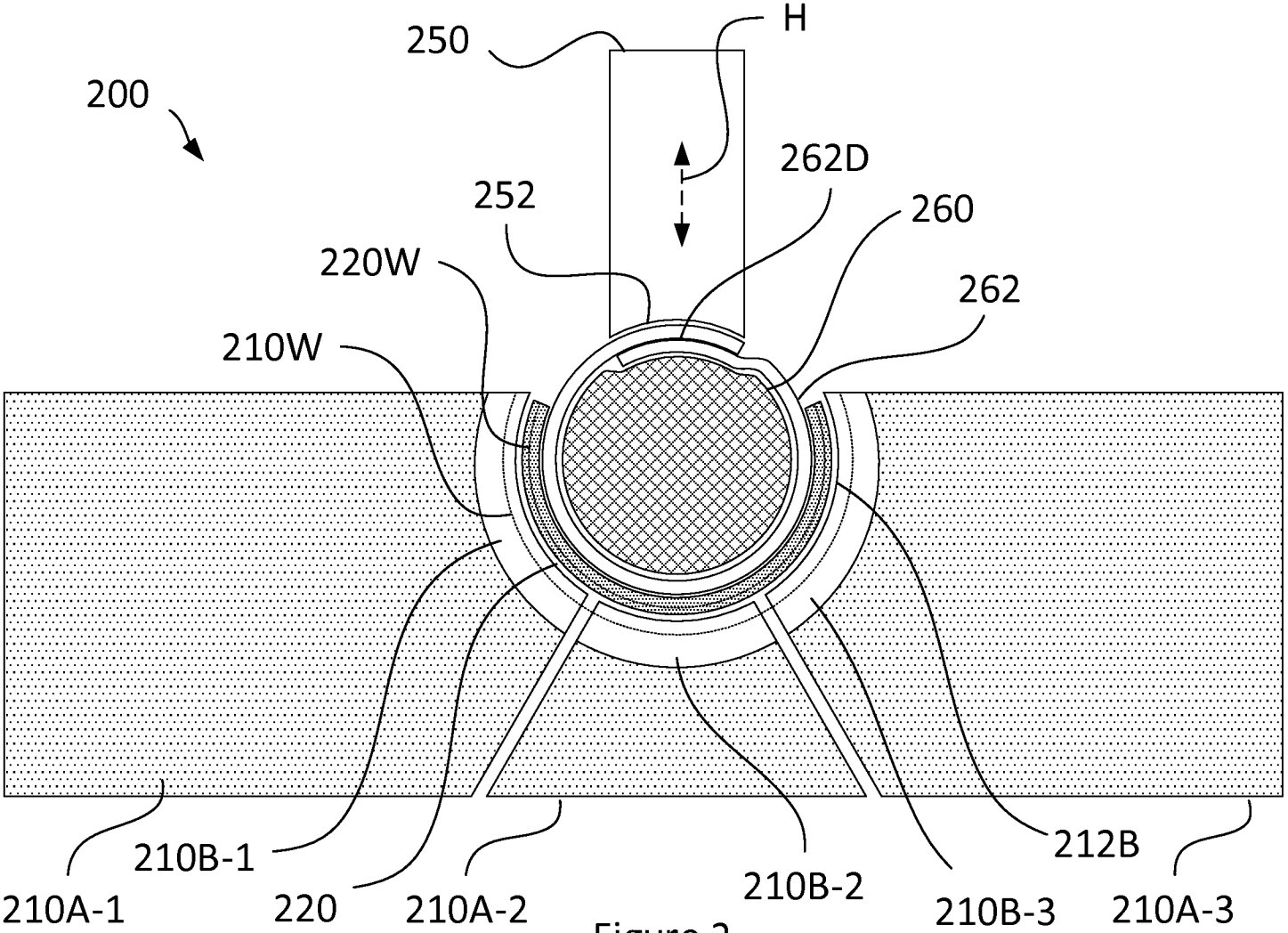
FIG. 2 shows a cross-sectional view through a second reconfigurable wrapping mechanism in an unworn condition.

As shown in FIG. 2 the garniture bed sub-members 110-1, 110-2 and 110-3 may each have a replaceable formation channel liner sub-member (not shown in FIGS. 1A-1C) which is detachably connected to a complementary base sub-member, with the elongate formation channel being provided in the liner sub-members.

The formation channel 112, conveying belt 120 and the concave face 152 of the shoe 150 (where present) are arranged and complementarily shaped for forming and transporting a substantially cylindrical member, entrained on the conveying belt, for example, a generally cylindrical core 160 wrapped within a wrapping paper 162. In use, the belt drive mechanism drives the conveying belt 120 along the formation channel 112 in the transport direction T (indicated in FIG. 1A), the wrapping paper 162 is received onto and extends along the conveying belt 120, the core 160 is received onto the wrapping paper, and the wrapping paper is wrapped around the core. As the conveying belt 120 draws the wrapping paper 162 and the core 160 along the inlet section 112A and the middle section 1128 of the formation channel 112, the wrapping paper is progressively wrapped around the core, before the wrapped core exits the formation channel along the outlet section 112C. Whilst passing along the formation channel 112 (for example, in the middle section 112B), the wrapping paper 162 is sealed around the core 160.

In the illustrated reconfigurable wrapping assembly 100, the illustrated shoe 150 has a constant cross-sectional shape along its length, and extends along the middle section 112B of the formation channel 112. However, to enhance wrapping performance, the shoe 150 may have a shape that varies along the length of the formation channel 112. However, the shoe 150 may extend part or all of the length of the inlet section 112A, part or all of the length of the middle section 112B, part or all of the length of the outlet section 112C, or may extend along part or all of a combination adjacent sections 112A, 112B, 112C of the formation channel 112.

During manufacturing, when the wrapping paper 162 has been wrapped around the core 160, a double layered region 162D may pass along the concave surface 152 of the shoe 150 (or similarly, the double layered region 562B may pass along a concave surface of the formation channel 512, as shown in FIG. 5).

A contact adhesive may be provided between the layers in the double layered region 162D, and adhesion may be facilitated by contact between the double layered region and one or both of the conveying belt 120 and the formation channel 112. Alternatively, or additionally, a thermosetting adhesive may be provided between the layers in the double layered region 162D. At least part of the concave surface 152 of the shoe 150 (or the surface of the formation channel 512, in the arrangement of FIG. 5) may be provided with a heating region (not shown) that heats the double layered region 162D to dry or melt an adhesive between the layers, and the concave surface 152 of the shoe 150 (or the surface of the formation channel 512, in the arrangement of FIG. 5) may optionally also be provided with a cooling region (not shown) to cool the adhesive.

With continued use, the conveying belt 120 may be worn thinner, for example, being worn back to the dashed line indicated by 120W. Alternatively, or additionally, the surface of the formation channel 112 may be worn away by the conveying belt 120, for example, being worn back to the dashed line indicated by 110W.

When a user or an automated monitoring mechanism (not shown) detects one or both of a worn garniture bed 110' and a worn conveying belt 120' (each being worn only within a respective wear tolerance), the garniture bed sub-members 110-1', 110-2' and 110-3' may be moved inwardly (or outwardly) M-1, M-2 and M-3, to reconfigure the formation channel 112' to compensate for the wear. The shoe 150 may also move inwardly H to further compensate for wear. The garniture bed sub-members 110-1', 110-2' and 110-3' and the shoe 150 may move radially with respect to a central axis extending along the core 160.

Where wear of the conveying belt 120, the garniture bed sub-members 110-1, 110-2 and 110-3, or both the conveying belt and the garniture bed sections is detected and the conveying belt may be used further, the garniture bed sub-members 110-1, 110-2 and 110-3 may be moved M-1, M-2 and M-3 inwardly to compensate for the worn conveying belt, for example, moving inwardly to provide a smaller diameter in the middle section 112B.

Where wear of the conveying belt 120 is detected and the conveying belt is replaced, the garniture bed sub-members 110-1, 110-2 and 110-3 may be moved M-1, M-2 and M-3 outwardly to compensate for the replacement of the worn conveying belt, for example, moving outwardly to provide a larger diameter in the middle section 112B. Additionally, the height of the shoe 150 (where present) above the base of the formation channel 112 (for example, in the middle section 112B) may be adjusted, H, in correspondence with reconfiguration of the garniture bed 110, and in correspondence with wear of the conveying belt 120.

Reconfiguration of the garniture bed can enable continued use of one or both of a conveying belt and a garniture bed even when one or both have become worn, which may increase the time for which the wrapping mechanism may be run before it becomes necessary to replace the conveying belt or formation channel. Prolonging the running time of parts may increase operational efficiency and reduce operational costs.

By movement of one or more of the garniture bed base section(s), both the substantially cylindrical shape and the cross-sectional area of the wrapped core may be maintained within narrower tolerances.

FIG. 2 shows a cross-sectional view through a second reconfigurable wrapping mechanism 200 in an unworn condition, which is generally similar to the first reconfigurable wrapping mechanism 100 of FIG. 1A.

The second reconfigurable wrapping mechanism 200 differs from the first reconfigurable wrapping mechanism 100 by the moveable garniture bed sub-members of the garniture bed 210 each being of a composite construction, having base sub-members 210A-1, 210A-2 and 210A-2 and replaceable formation channel liner sub-members 210B-1, 210B-2 and 210B-3, which are each detachably connected to a respective base sub-section, with the elongate formation channel 212 being provided by the assembly of formation channel liner sub-members.

The formation channel 212, conveying belt 220 and the concave face 252 of the shoe 250 are arranged and complementarily shaped for forming and transporting a substantially cylindrical member, for example, a generally cylindrical core 260 wrapped within a wrapping paper 262, in a similar manner to the first reconfigurable wrapping mechanism 100, shown in FIGS. 1A to 1C.

With continued use, the conveying belt 220 may be worn thinner, for example, being worn back to the dashed line indicated by 220W. Alternatively, or additionally, the surface of the formation channel 212 may be worn away by the conveying belt 220, for example, with the formation channel liner sub-members 210B-1, 210B-2 and 210B-2 being worn back to the dashed line indicated by 210W.

When the user or an automated monitoring mechanism (not shown) detects wear of one or both of the garniture bed 210 and the conveying belt 220, the garniture bed base sub-members 210A-1, 210A-2 and 210A-3 may be moved inwardly to reconfigure the formation channel 212 to compensate for the wear. The shoe 250 may also move inwardly H to further compensate for wear.

Reconfiguration of the garniture bed can enable continued use of one or both of a conveying belt and a garniture bed even when one or both have become worn, which may increase the time for which the wrapping mechanism may be run before it becomes necessary to replace the conveying belt or formation channel. Prolonging the running time of parts may increase operational efficiency and reduce operational costs.

By movement of one or more of the garniture bed base sub-member(s), both the substantially cylindrical shape and the cross-sectional area of the wrapped core may be maintained within narrower tolerances.

By replacement of one or more of the replaceable formation channel liner sub-member(s), both the substantially cylindrical shape and the cross-sectional area of the wrapped core may be maintained within narrower tolerances.

Figure 3A:
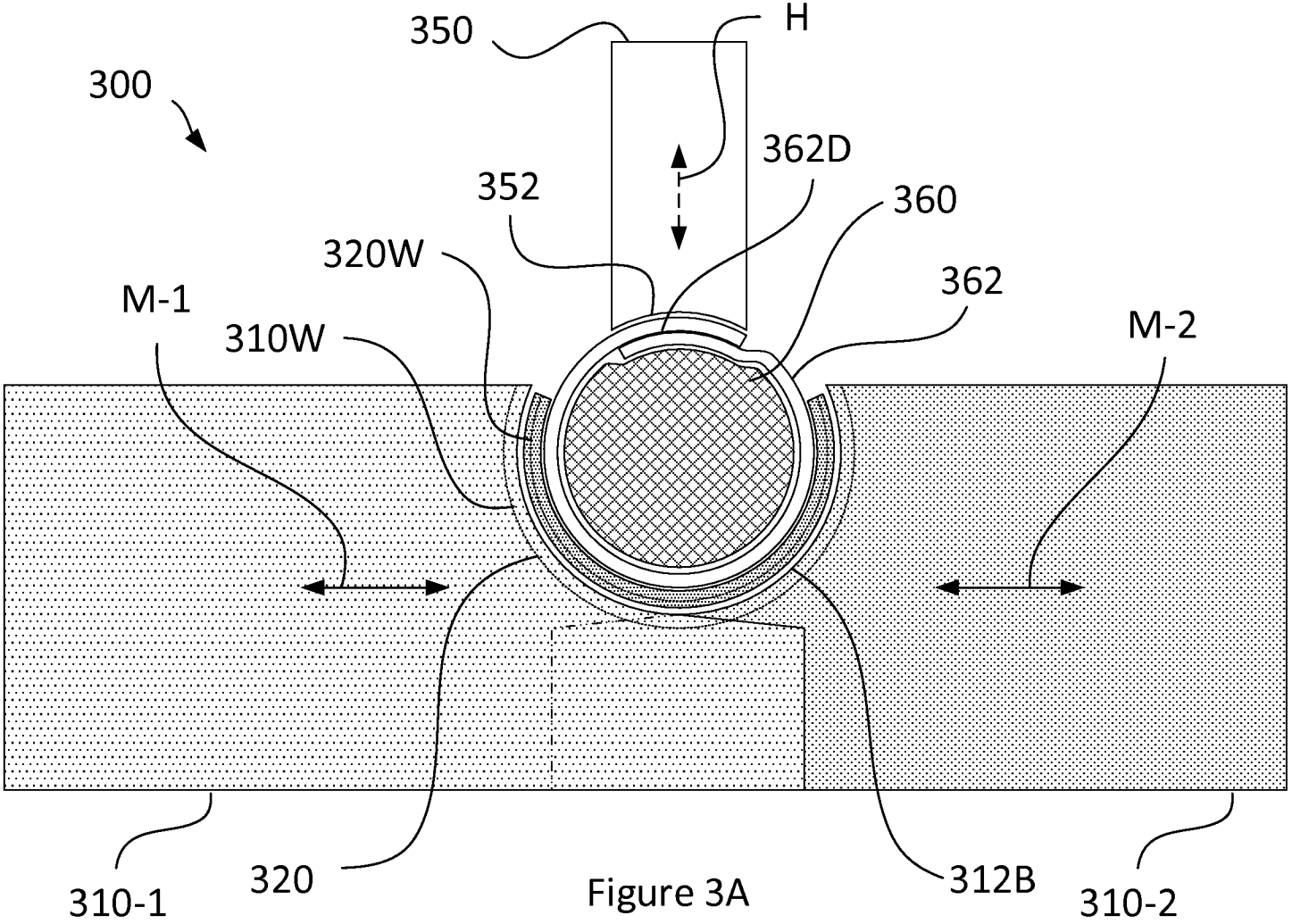
FIG. 3A shows a cross-sectional view through a third reconfigurable wrapping mechanism in an unworn condition.
Figure 3B:
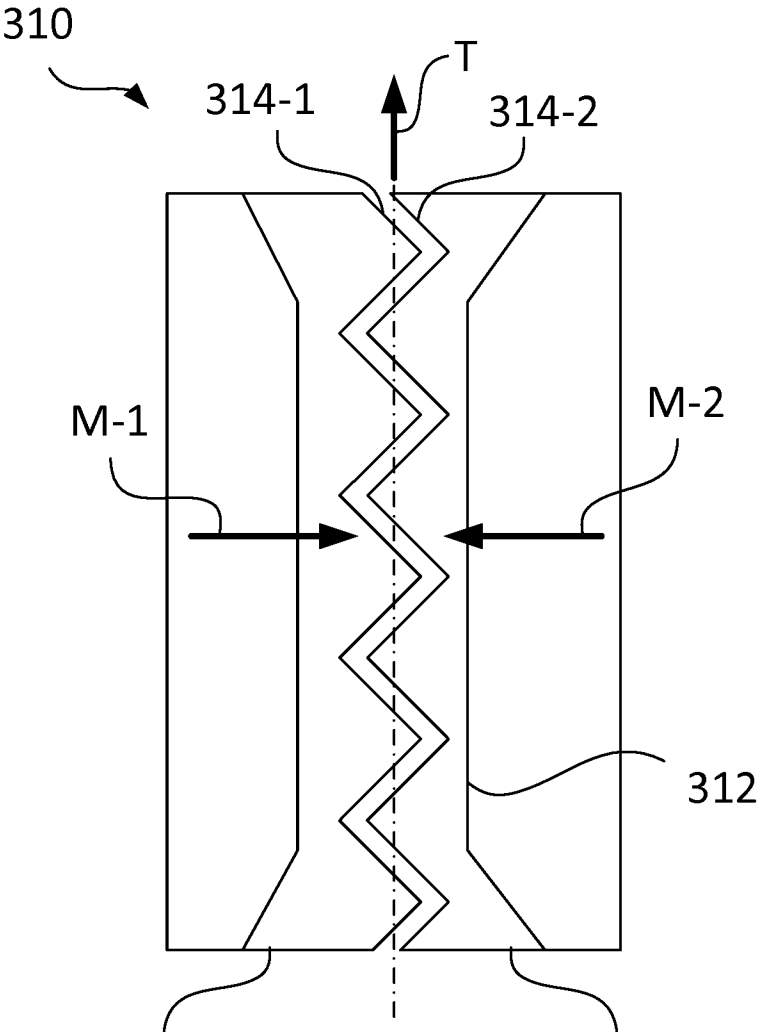
FIG. 3B shows a plan view of the garniture bed of the third reconfigurable wrapping mechanism of FIG. 3A.

FIG. 3A shows a cross-sectional view through a third reconfigurable wrapping mechanism 300 in an unworn condition, and FIG. 3B shows a plan view of the garniture bed 310 of FIG. 3A.

The wrapping mechanism 300 has a garniture bed 310 with a formation channel 312 extending along its length. A conveying belt 320 extends along the surface of the formation channel 312, and both are open along the length of the formation channel, with the open side facing towards an elongate shoe 350. The conveying belt 320 may be an endless belt. A belt drive mechanism (not shown) is provided to drive the conveying belt 320 along the formation channel 312, in the transport direction T.

The shoe 350 has a concave face 352, in cross-section perpendicular to the length of the formation channel 312, which faces towards the open side of the formation channel 312. The formation channel 312, conveying belt 320 and the concave face 352 of the shoe 350 are arranged and complementarily shaped for forming a substantially cylindrically shaped wrapped rod, for example, a generally cylindrical core 360 wrapped within a wrapping paper 362.

The third garniture bed 310 is of a composite construction, having moveable sub-members 310-1 and 310-2, each providing part of the formation channel 312. The garniture bed sub-members 310-1 and 310-2 may connect to a common support (not shown). The sub-members 310-1 and 310-2 may each have a replaceable formation channel liner sub-member (not shown) which is detachably connected to a complementary base sub-member, with the elongate formation channel being provided in the formation channel liner sub-members.

The formation channel 312, conveying belt 320 and the concave face 352 of the shoe 350 are arranged and complementarily shaped for forming and transporting a substantially cylindrical member, for example, a generally cylindrical core 360 wrapped within a wrapping paper 362, in a similar manner to the first reconfigurable wrapping mechanism 100, shown in FIGS. 1A to 1C.

With continued use, the conveying belt 320 may be worn thinner, for example, being worn back to the dashed line indicated by 320W. Alternatively, or additionally, the surface of the formation channel 312 may be worn away by the conveying belt 320, for example, being worn back to the dashed line indicated by 310W.

When the user or an automated monitoring mechanism (not shown) detects one or both of a worn garniture bed 310 and the conveying belt 420, the garniture bed sub-members 310-1 and 310-2 may be moved inwardly M-1 and M-2, to reconfigure the formation channel 312 to compensate for the wear. The shoe 450 may also move inwardly H to further compensate for wear.

In the illustrated third reconfigurable wrapping mechanism 300, the moveable sub-members 310-1 and 310-2 are configured to move inwardly (or outwardly) and parallel to each other, and perpendicular to movement H of the shoe 350 (for example, each of the garniture bed sections 310-1, and 310-2 and the shoe 350 may move radially with respect to a central axis extending along the core 360). However, the moveable parts of the wrapping mechanism may alternatively be configured to move inwardly at different angles (for example, in a symmetrical arrangement).

Reconfiguration of the garniture bed can enable continued use of one or both of a conveying belt and a garniture bed even when one or both have become worn, which may increase the time for which the wrapping mechanism may be run before it becomes necessary to replace the conveying belt or formation channel. Prolonging the running time of parts may increase operational efficiency and reduce operational costs.

By movement of one or more of the garniture bed base sub-member(s), both the substantially cylindrical shape and the cross-sectional area of the wrapped core may be maintained within narrower tolerances.

By replacement of one or more of the formation channel liner sub-section(s), both the substantially cylindrical shape and the cross-sectional area of the wrapped core may be maintained within narrower tolerances.

As is shown in FIG. 3B, at the formation channel surface 312, the facing edges 314-1 and 314-2 of the garniture bed sub-members 310-1 and 310-2 (or composite garniture bed sub-members, each having a base sub-member and a formation channel liner sub-member) may have interdigitated arrangements of teeth, which permit the garniture bed sub-members to move inwardly (or outwardly). The teeth along the facing edges 314-1 and 314-2 remain interleaved, providing enhanced support for the conveying belt 320, web material and core. The facing edges may have complementary zig-zig shaped edges.

The moveable sections 110-1, 110-2, 110-3, 210-1 and 210-2 of other reconfigurable wrapping mechanisms 100 and 200 may additionally be provided with interdigitated arrangements of teeth along their facing edges, at the formation channel surface 112, 212.

Figure 4:
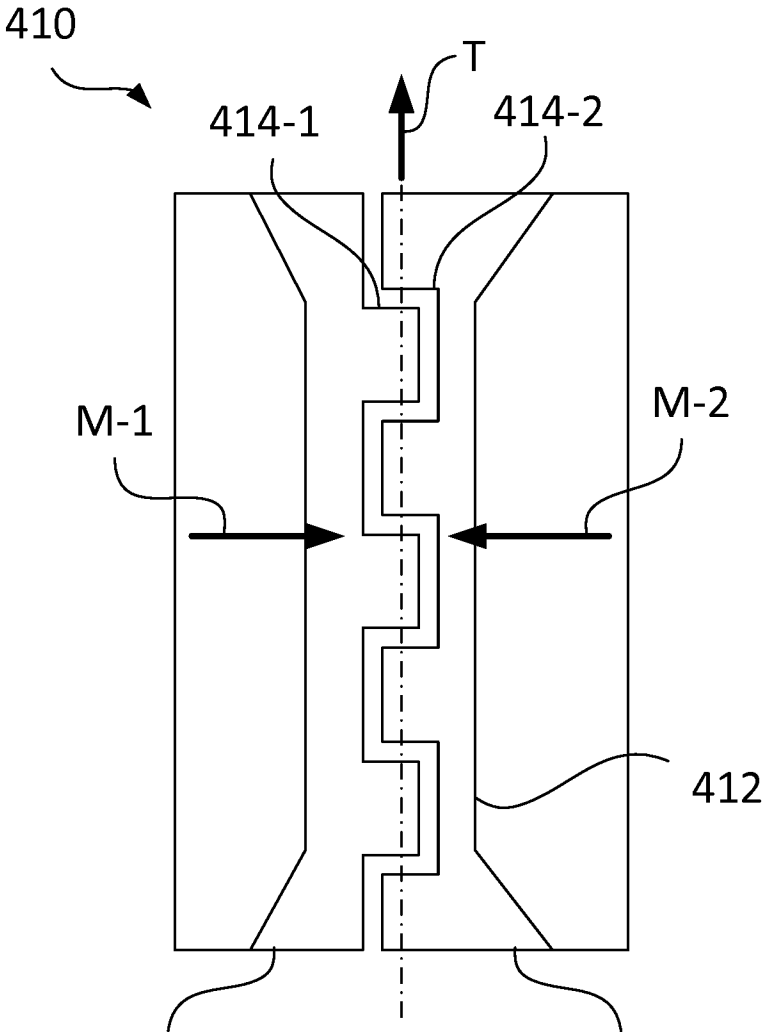
FIG. 4 shows a plan view of a garniture bed of a fourth reconfigurable wrapping mechanism.

FIG. 4 shows a fourth composite garniture bed 410 having garniture bed sections 410-1 and 410-2 that is generally similar to the composite garniture bed 310 of FIGS. 3A and 3B.

The garniture bed 410 of FIG. 4 differs from the garniture bed 310 of FIGS. 3A and 3B by the interdigitated facing edges 414-1 and 414-2 having complementary castellated shapes.

Formation channel assemblies 100, 200, 300, and 400 of FIGS. 1A to 4 have one, two or three sections that each provide part of the formation channel surface. Alternatively, the garniture bed may a larger number of sections that each provide part of the formation channel surface.

The reconfigurable wrapping mechanisms 100, 200, and 300 illustrated in FIGS. 1A to 3A each comprise an elongate shoe 150, 250, and 350. However, alternatively, the elongate shoe may be omitted from the reconfigurable wrapping mechanisms.

FIG. 5 shows a cross-sectional view through a fifth reconfigurable wrapping mechanism 600 in an unworn condition, which is generally similar to the first reconfigurable wrapping mechanism 100 of FIGS. 1A to 1C.

The fifth reconfigurable wrapping mechanism 500 differs from the first reconfigurable wrapping mechanism 100 by omitting the elongate shoe 150.

The formation channel 512 and conveying belt 520 are shaped for forming and transporting a substantially cylindrical member, entrained on the conveying belt, for example, a generally cylindrical core 560 wrapped within a wrapping paper 562. In use, the belt drive mechanism drives the conveying belt 520 along the formation channel 512 (for example, in the transport direction T, as indicated in FIG. 1A), the wrapping paper 562 is received onto and extends along the conveying belt 520, the core 560 is received onto the wrapping paper, and the wrapping paper is wrapped around the core.

During manufacturing, when the wrapping paper 562 has been wrapped around the core 560, a double layered region 562D may pass along the concave surface of the formation channel 512. A contact adhesive may be provided between the layers in the double layered region 562D, and adhesion may be facilitated by contact between the double layered region and one or both of the conveying belt 520 and the formation channel 512. Alternatively, or additionally, a thermosetting adhesive may be provided between the layers in the double layered region 562D. At least part of the concave surface of the formation channel 512 may be provided with a heating region (not shown) that heats the double layered region 562D to dry or melt the adhesive, and the formation channel 512 may optionally also be provided with a cooling region (not shown) to cool the double layered region.

With continued use, the conveying belt 520 may be worn thinner, for example, being worn back to the dashed line indicated by 520W. Alternatively, or additionally, the replaceable formation channel liner 510B may be worn away by the conveying belts 520, for example, being worn back to the dashed line indicated by 510W.

When a user or an automated monitoring mechanism (not shown) detects one or both of a worn garniture bed 510 and a worn conveying belt 520 (each being worn only within a respective wear tolerance), the garniture bed sub-members 510-1, 510-2 and 510-3 may be moved inwardly (or outwardly) M-1, M-2 and M-3, to reconfigure the formation channel 512 to compensate for the wear. The garniture bed sub-members 510-1, 510-2 and 510-3 may move radially with respect to a central axis extending along the core 560.

Where wear of the conveying belt 520, the garniture bed sub-members 510-1, 510-2 and 510-3, or both the conveying belt and the garniture bed sections is detected and the conveying belt may be used further, the garniture bed sub-members 510-1, 510-2 and 510-3 may be moved M-1, M-2 and M-3 inwardly to compensate for the worn conveying belt, for example, moving inwardly to provide a smaller diameter in the middle section 512B.

Where wear of the conveying belt 520 is detected and the conveying belt is replaced, the garniture bed sub-members 510-1, 510-2 and 510-3 may be moved M-1, M-2 and M-3 outwardly to compensate for the replacement of the worn conveying belt, for example, moving outwardly to provide a larger diameter in the middle section 512B.

Reconfiguration of the garniture bed can enable continued use of one or both of a belt and a garniture bed even when one or both have become worn, which may increase the time for which the wrapping mechanism may be run before it becomes necessary to replace the belt or formation channel. Prolonging the running time of parts may increase operational efficiency and reduce operational costs.

By reconfiguration, both the substantially cylindrical shape and the cross-sectional area of the wrapped core may be maintained within narrower tolerances.

The figures provided herein are schematic and not to scale.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A reconfigurable wrapping mechanism for forming a substantially cylindrical wrapped element by wrapping a core within a web material, comprising a reconfigurable garniture bed having an elongate formation channel for supporting a conveying belt extending along the length of the elongate formation channel for entraining the web material, and wherein the elongate formation channel has an elongate open side, wherein the garniture bed comprises a plurality of garniture bed sub-members, wherein, in a direction extending around the surface of the elongate formation channel perpendicular to the length of elongate formation channel, each garniture bed sub-member provides a portion of the surface of the elongate formation channel, wherein at least one of the garniture bed sub-members is configured for movement transverse to the length of the elongate formation channel, wherein the elongate formation channel has a central axis extending along its length and the garniture bed sub-members are configured for substantially radial movement relative to the central axis, and wherein adjacent edges of the or a plurality of the garniture bed sub-members are interdigitated and shaped to increase or decrease the level of interdigitation during the substantially radial movement relative to the central axis.

2. The wrapping mechanism according to claim 1, wherein each garniture bed sub-member comprises:

a base sub-member; and a replaceable formation channel liner sub-member detachably connected to a respective base sub-member.

3. The wrapping mechanism according to claim 1, wherein the or a plurality of the garniture bed sub-members are configured for substantially symmetrical movements.

4. The wrapping mechanism according to claim 1, comprising an elongate shoe provided adjacent and extending along the elongate open side of the elongate formation channel for slideably contacting at least one of the wrapped element, core and web material.

5. The wrapping mechanism according to claim 4, comprising one or both:

the elongate shoe is configured for movement towards the garniture bed transverse to the length of elongate formation channel; and the garniture bed is configured for movement towards the elongate shoe transverse to the length of elongate formation channel.

6. The wrapping mechanism according to claim 1, comprising a conveying belt extending along the length of the elongate formation channel for entraining the web material.

7. The wrapping mechanism according to claim 1, comprising a drive mechanism for driving a conveying belt along the length of the elongate formation channel.

8. A method of reconfiguring a garniture bed in a wrapping mechanism for forming a substantially cylindrical wrapped element by wrapping a core within a web material, the wrapping mechanism comprising a reconfigurable garniture bed having an elongate formation channel for supporting a conveying belt extending along the length of the elongate formation channel for entraining the web material, and wherein the elongate formation channel has an elongate open side, wherein the garniture bed comprises a plurality of garniture bed sub-members, wherein, in a direction extending around the surface of the elongate formation channel perpendicular to the length of elongate formation channel, each garniture bed sub-member provides a portion of the surface of the elongate formation channel, and wherein at least one of the garniture bed sub-members is configured for movement transverse to the length of the elongate formation channel, and the method comprises relative movement of the garniture bed sub-members transversely to the length of the elongate formation channel to adjust the size of the elongate formation channel, wherein the elongate formation channel has a central axis extending along its length and the garniture bed sub-members and the method comprises relative movement of the garniture bed sub-members is substantially radially relative to the central axis, and wherein adjacent edges of the or a plurality of the garniture bed sub-members are interdigitated, and the method comprises the relative radial movement of the garniture bed sub-members to increase or decrease the level of interdigitation.

9. The method according to claim 8, wherein each garniture bed sub-member comprises:

a base sub-member; and a replaceable formation channel liner sub-member detachably connected to a respective base sub-member, and the method comprises detaching and replacing a formation channel liner sub-member.

10. The method according to claim 8, wherein the or a plurality of the garniture bed sub-members are configured for substantially symmetrical movements.

11. The method according to claim 8, the wrapping mechanism comprising:

an elongate shoe provided adjacent and extending along the elongate open side of the elongate formation channel for slideably contacting at least one of the wrapped element, core and web material, the method comprising one or both:

the elongate shoe is configured for movement towards the garniture bed transverse to the length of elongate formation channel; and the garniture bed is configured for movement towards the elongate shoe transverse to the length of elongate formation channel.

12. The method according to claim 8, wherein the method comprises reconfiguration of garniture bed to provide a narrower formation channel.

13. The method according to claim 8, wherein the wrapping mechanism comprises a conveying belt extending along the length of the elongate formation channel for entraining the web material, and wherein the method comprises reconfiguration of garniture bed to provide a wider formation channel, and the method further comprises replacement of the conveying belt.

14. A method of manufacturing a substantially cylindrical wrapped element with a wrapping mechanism comprising:

a reconfigurable garniture bed having an elongate formation channel for supporting a conveying belt extending along the length of the elongate formation channel for entraining the web material, and wherein the elongate formation channel has an elongate open side; wherein the garniture bed comprises a plurality of garniture bed sub-members, wherein, in a direction extending around the surface of the elongate formation channel perpendicular to the length of elongate formation channel, each garniture bed sub-member provides a portion of the surface of the elongate formation channel, and wherein at least one of the garniture bed sub-members is configured for movement transverse to the length of the elongate formation channel; and a conveying belt extending along the length of the elongate formation channel; and a drive mechanism for driving the conveying belt along the length of the elongate formation channel, the method comprising:

driving the conveying belt and an entrained web material along the elongate formation channel with the drive mechanism;

receiving a core onto the entrained web material; and wrapping the core within a web material, wherein the elongate formation channel has a central axis extending along its length and the garniture bed sub-members and the method comprises relative movement of the garniture bed sub-members is substantially radially relative to the central axis, and wherein adjacent edges of the or a plurality of the garniture bed sub-members are interdigitated, and the method comprises the relative radial movement of the garniture bed sub- members to increase or decrease the level of interdigitation.

* * * * *